United States Patent [19]

Chang et al.

[11] 4,309,117

[45] Jan. 5, 1982

[54] RIBBON CONFIGURATION FOR RESISTIVE RIBBON THERMAL TRANSFER PRINTING

[75] Inventors: Leo S. Chang, San Jose; Anthony DeMore, Santa Cruz, both of Calif.

[73] Assignee: International Business Machines Corporation, Armonk, N.Y.

[21] Appl. No.: 106,614

[22] Filed: Dec. 26, 1979

[51] Int. Cl.[3] ..... B41J 31/02

[52] U.S. Cl. ..... 400/241.1; 400/120; 346/76 PH; 428/411

[58] Field of Search ..... 400/118, 119, 120, 241, 400/241.1; 346/76 R, 76 PH, 135, 135.1; 219/216; 428/411, 412, 425.5, 474.4, 474.7, 474.9, 480

[56] References Cited

U.S. PATENT DOCUMENTS

| | | | |
|---|---|---|---|
| 3,072,543 | 1/1963 | Lubow et al. | 346/135.1 X |
| 3,377,599 | 4/1968 | Reis | 346/76 PH |
| 3,442,699 | 5/1969 | Dalton | 346/135.1 X |
| 3,744,611 | 7/1973 | Montanari et al. | 400/120 |
| 4,103,066 | 7/1978 | Brooks et al. | 400/120 X |

OTHER PUBLICATIONS

IBM Technical Disclosure Bulletin, "Thermal Display Printer", Kitamura, vol. 16, No. 7, Dec. 1973, p. 2189.

IBM Technical Disclosure Bulletin, "Resistive Ribbon Thermal Transfer Printing Method", Crooks et al., vol. 19, No. 11, Apr. 1977, p. 4396.

IBM Technical Disclosure Bulletin, "Resistive Ribbon Printing of Typewriter Keys", Wilbur, vol. 20, No. 12, May 1978, p. 5314.

IBM Technical Disclosure Bulletin, "Integrated Polyacetylene Structure for Resistive Ribbon Thermal Transfer Printing", Clarke et al., vol. 21, No. 12, May 1979, p. 5011.

IBM Technical Disclosure Bulletin, "Resistive Ribbon Ink Layers", Crooks et al., vol. 22, No. 2, Jul. 1979, p. 782.

European Patent Application, 9,595, "Electrothermal Printing Apparatus", Wilbur, Published 4/16/80.

*Primary Examiner*—Ernest T. Wright, Jr.

*Attorney, Agent, or Firm*—Joseph E. Kieninger

[57] ABSTRACT

A resistive ribbon thermal transfer printing apparatus has an improved ribbon configuration. The ribbon contains a two-ply resistive element positioned on a conductive layer. The resistive element contains a top layer having a low resistance, for example $3\times10^{-5}\Omega$ for making contact with the writing head and a bottom layer having a higher resistance, for example $1\times10^{-3}\Omega$ in contact with the conductive layer for generating heat. The ratio of the resistance of the high resistance layer to the resistance of the low resistance layer, $R_H/R_L$, is 1.1 to 1000. An example of such a ribbon contains a top resistive layer of polyimide containing 35% conductive carbon, a bottom resistive layer of a SiO/Cr cermet (60%/40%), a stainless steel conductive layer and a Versamid ink layer.

9 Claims, 1 Drawing Figure

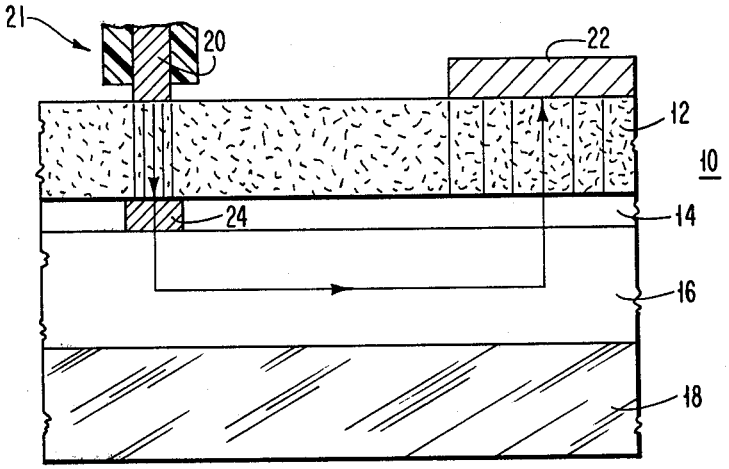
21
20
22
12
10
24
14
16
18

RIBBON CONFIGURATION FOR RESISTIVE RIBBON THERMAL TRANSFER PRINTING

DESCRIPTION

1. Technical Field

This invention relates to a ribbon configuration for non-impact resistive ribbon thermal transfer printing, and more particularly to a resistive ribbon having two resistive layers.

It is a primary object of this invention to provide an improved ribbon configuration for a non-impact resistive ribbon thermal transfer printing apparatus.

It is another object of this invention to provide a ribbon configuration that requires less power to print.

It is another object of this invention to provide a ribbon configuration which permits higher resolution of the printed subject matter.

It is yet still another object of this invention to provide a ribbon configuration that results in lower contact resistance between the electrodes and the ribbon.

It is yet still another object of this invention to provide a ribbon configuration that permits the ribbon to be reusable.

2. Background Art

Various electrothermic printing apparati have been proposed to momentarily heat selected areas of ribbon for imaging a record on adjacent thermally sensitive paper. In one popular type of these printing devices, a row of side-by-side heads is often provided for sweeping movement relative to the thermally sensitive paper to effect printing of characters or other indicia in dot matrix fashion. Individual heads typically consist of small resistive elements which must be heated to a temperature high enough to color the paper to the desired degree of resolution. This type of printing unit has been found to involve a number of problems in their design and operation. One such problem stems from the fact that the growing need for greater resolution requires smaller heads which can be heated to higher temperatures over shorter periods of time. The rapid heating of relatively small heads to relatively high temperatures produces the requisite resolution in printing speed, but at the expense of greatly shortened head life as the resistive heating elements within the heads deteriorate quickly. A further problem which greatly shortens head life results from the fact that the heads must usually be maintained in physical contact with the thermally sensitive paper to provide the desired resolution. The surface of such paper tends to be rather abrasive, resulting in premature head wear.

Another type of electrothermic printing apparatus has been developed in which electrically resistive heating elements are combined into a single ribbon at selected areas by an arrangement of energizable electrodes in order to solve the problems mentioned above. One such printing unit is described in U.S. Pat. No. 3,744,611 in which a resistive ribbon printing apparatus includes a ribbon having three layers. These layers consist of a conductive layer interposed between a resistive layer and a thermal transfer layer, the latter comprising an ink coating that is selectively transferred to paper. The conductive layer is necessary to provide a short current path through the resistive layer in order to maintain localized heating to insure good resolution in the image that is transferred to the paper. Printing arrangements of this type avoid some of the severe head wear problems present in other types of systems, but at the expense of certain problems of their own. One problem is the rather poor resolution that often results from the extreme difficulty in heating a small and well defined portion of the ink to a selected degree. These arrangements are frequently incapable of localizing the heating to a small discrete area of the ribbon. In addition, there is wear on the electrode head and on the ribbon due to the relative high contact resistance between the electrode and the resistive layer of the ribbon. In addition, arrangements of this type tend to require a relatively high level of power to print.

DISCLOSURE OF THE INVENTION

According to the invention, a resistive ribbon thermal transfer printing apparatus has an improved ribbon configuration. The ribbon contains a two-ply resistive element positioned on a conductive layer. The resistive element contains a top layer having a low resistance, for example, $3\times10^{-5}\Omega$, for making contact with the writing head and a bottom layer having a high resistance for example, $1\times10^{-3}\Omega$, in contact with the conductive layer for generating heat. The ratio of the resistance of high resistance layer to the resistance of the low resistance layer, $R_H/R_L$, is 1.1 to 1000. A preferred resistance ratio, $R_H/R_L$, $\geqq 25$ provides high quality print. An example of such a ribbon contains a top resistive layer about 3.0 microns thick of polyimide containing 35% conductive carbon, a bottom resistive layer 0.05 microns thick of a SiO/Cr cermet (60%/40%), a stainless steel layer 5.1 microns thick and a Versamid ink layer 5 microns thick.

BRIEF DESCRIPTION OF THE DRAWING

In the accompanying drawing forming a material part of this disclosure:

The FIGURE is a schematic cross-section of the ribbon according to the invention.

BEST MODE FOR CARRYING OUT THE INVENTION

In accordance with this invention as shown in the FIGURE the resistive ribbon 10 includes a low resistance resistive layer 12, a high resistance resistive layer 14, a conductive layer 16 and an ink layer 18. The low resistance layer 12 has a resistance which can fall within a broad range depending upon the resistance of layer 14. Examples of suitable resistances are $3\times10^{-5}\Omega$, and $60\times10^{-5}\Omega$. Examples of suitable materials for layer 12 are polyimide containing 35% carbon, polycarbonate containing 30% carbon, polyester containing 32% carbon and polyurethane containing 30% carbon. Other polymeric materials may be used and the amount of carbon added is selected to obtain the appropriate resistance. The thickness of low resistance layer 12 on the resistivity of the material and may be, for example, 3 microns, 12 microns or 0.1 microns.

The high resistance layer 14 has a resistance which can fall within a broad range depending on the resistance of layer 12. Examples of suitable resistances for layer 14 are $2\times10^{-4}\Omega$, $7\times10^{-4}\Omega$, $1\times10^{-3}\Omega$ and $5\times10^{-2}\Omega$. A preferred material for high resistance layer 14 is a SiO/Cr (60%/40%) cermet. Other materials which may be used are SiC and $Al_2O_3$.

The selection of the materials for resistive layers 12 and 14 as well as their thicknesses are determined so as to obtain a ratio of the resistances of these layers, $R_H/R_L$, that is 1.1–1000. A preferred $R_H/R_L$ of $\geqq 25$ provides high quality print.

The conductive layer 16 may be stainless steel that is, for example, 5.1 microns thick or it may be aluminum that is, for example, 0.1 micron thick. Other conductive metals including copper and gold may be used. The stainless steel material is a preferred material since its use permits the ribbon 10 to be reusable.

The ink layer 18 is a conventional layer and is a Versamid ink layer in the preferred embodiment. Other conventional ink or thermal transfer layers such as described in the prior art may be used.

The current flows from the print electrode 20 through the low resistive layer 12, the high resistive layer 14, the conductive layer 16 and back through layers 14 and 12 to ground electrode 22. In a preferred embodiment the printing electrode 20 is an integral part of the printing head 21. Although there is some heating in layer 12, most of the heating is generated in the localized region 24 of layer 14 to effect printing with layer 18. Ground electrode 22 has a large surface area relative to print electrode 20 to prevent heating and printing under electrode 22. The lateral resistance between the electrodes 20 and 22 parallel to layer 12 is much higher than the resistance between these electrodes 20, 22 through the resistive layers 12 and 14 and conductive layer 16.

EXAMPLE NO. 1

A ribbon substrate was made of stainless steel having a thickness of 5 microns. A high resistive layer 0.10 microns thick of SiO/Cr (60/40) cermet was deposited on the substrate. The calculated resistance for 1 $cm^2$ was $7.5\times10^{-4}\Omega$. On top of this high resistance layer was deposited a low resistance layer of polyimide which had a thickness of three microns when cured. The polyimide was dispersed with 35% by weight of conductive carbon. The calculated resistance for 1 $cm^2$ of this layer was $3\times10^{-5}\Omega$. The $R_H/R_L$ was 25. The ribbon substrate, the high resistance layer and the low resistance layer were cured under tension at 350° C. for one hour. An ink layer of Versamid having a thickness of five microns was then deposited on the uncoated side of the stainless steel ribbon. The resultant ribbon configuration was used for thermal transfer printing and good quality prints were obtained at a speed of 20 inches per second. This ribbon is also reusable since it has a stainless steel conductive layer therein. Thermal transfer printing at a speed of 10 inches per second was effected with 500 milliwatts of power, whereas a prior art stainless steel ribbon required 750 milliwatts and produced a lower quality print.

Examples 1 through 8 are listed below in tabular form:

| | Low Resistance Layer | | | | High Resistance Layer | | | | Conductive Layer | | | |
|---|---|---|---|---|---|---|---|---|---|---|---|---|
| Example | Material | Thickness (μ) | (Ω . cm) | $R_L(\Omega)^a$ | Material | Thickness (μ) | (Ω . cm) | $R_H(\Omega)^a$ | Material | Thickness (μ) | $R_HR_L$ | Print Quality |
| 1 | Polyimide/ 35% carbon | 3 | 0.1 | $3\times10^{-5}$ | SiO/cr[b] | 0.10 | 75 | $7.5\times10^{-4}$ | Stainless Steel | 5 | 25 | Very good |
| 2 | Polyimide/ 35% carbon | 3 | " | " | " | 0.05 | 75 | $3.75\times10^{-4}$ | Stainless Steel | 5 | 12.5 | Good |
| 3 | Polyimide/ 35% carbon | 3 | " | " | " | 0.03 | 75 | $2.25\times10^{-4}$ | Stainless Steel | 5 | 7.5 | Good |
| 4 | Polyimide/ 35% carbon | 3 | " | " | " | 0.15 | 75 | $1.13\times10^{-3}$ | Stainless Steel | 5 | 38 | Very good |
| 5 | Polyimide/ 35% carbon | 3 | " | " | " | 0.30 | 75 | $2.25\times10^{-3}$ | Stainless Steel | 5 | 75 | Very good |
| 6 | Polyimide/ 35% carbon | 3.5 | " | " | S:C | 0.05 | 180 | $9.0\times10^{-4}$ | Stainless Steel | 5 | 30 | Very good |
| 7 | SiO/Cr[b] | 0.1 | 75 | $75\times10^{-5}$ | $Al_2O_3$ | ~0.005 | $10^5$ | $5.0\times10^{-2}$ | Aluminum | 0.1 | 67 | Very good |
| 8 | Polycarbonate/ 30% carbon | 12 | 0.5 | $60\times10^{-5}$ | $Al_2O_3$ | ~0.005 | $10^5$ | $5.0\times10^{-2}$ | Aluminum | 0.1 | 83 | Very good |

[a]Resistance Calculated for $1cm^2$
[b]60%/40%

The use of a thin high resistance layer 14 in close proximity to the ink layer 18 permits efficient utilization of the heat generated in the ribbon 10 exactly where it is wanted, thereby resulting in high resolution of the printed image. There is less thermal spread within the ribbon 10 because the layer 14 is thin and close to the ink layer 18. The use of the low resistance layer 12 in contact with the electrode 20 reduces the contact resistance between these two elements, thereby reducing the temperature in the interface which in turn minimizes the wear on both of these elements.

While the invention has been particularly shown and described with reference to the preferred embodiments thereof, it will be understood by those skilled in the art that the foregoing and other changes in form and details may be made therein without departing from the spirit, scope and teaching of the invention. Accordingly, the device herein disclosed is to be considered merely as illustrative, and the invention is to be limited only as specified in the claims.

We claim:

1. A resistive ribbon for thermal transfer printing comprising a two layered resistive layer having a first layer and a second layer wherein the ratio of the resistance of the second layer to the resistance of the first layer, $R_{second}/R_{first}$, is 1.1 to 1000, a conducting layer positioned on said second resistive layer, and an ink transfer layer positioned on said conductive layer.

2. A resistive ribbon as described in claim 1 wherein said first resistive layer contains a polymer and a conductive material dispersed therethrough.

3. A resistive ribbon as described in claim 1 wherein said second resistive layer is a cermet.

4. A resistive ribbon as described in claim 1 wherein said second resistive layer is a SiO/Cr cermet.

5. A resistive ribbon as described in claim 1 wherein said second resistive layer is silicon carbide.

6. A resistive ribbon as described in claim 1 wherein said conductive layer is stainless steel.

7. A resistive ribbon as described in claim 1 wherein said conductive layer is aluminum.

8. A resistive ribbon as described in claim 1 wherein said second resistive layer is aluminum oxide.

9. A resistive ribbon as described in claim 1 wherein said first resistive layer is in contact with a printing head.

* * * * *